US006695195B2

(12) United States Patent
Nishikawa et al.

(10) Patent No.: US 6,695,195 B2
(45) Date of Patent: Feb. 24, 2004

(54) COMBUSTION-POWERED NAIL GUN

(75) Inventors: Tomomasa Nishikawa, Hitachinaka (JP); Shinki Ohtsu, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/452,121

(22) Filed: Jun. 3, 2003

(65) Prior Publication Data

US 2003/0222114 A1 Dec. 4, 2003

(30) Foreign Application Priority Data

Jun. 3, 2002 (JP) ..... P2002-161836

(51) Int. Cl.[7] ..... B25C 1/08
(52) U.S. Cl. ..... 227/10; 227/130; 123/46 SC
(58) Field of Search ..... 227/8, 10, 130, 227/9; 123/46 SC

(56) References Cited

U.S. PATENT DOCUMENTS

| | | | | |
|---|---|---|---|---|
| 4,403,722 A | | 9/1983 | Nikolich | |
| 4,483,280 A | | 11/1984 | Nikolich | |
| RE32,452 E | | 7/1987 | Nikolich | |
| 5,197,646 A | | 3/1993 | Nikolich | |
| 5,687,898 A | * | 11/1997 | Toulouse | 227/10 |
| 5,687,899 A | * | 11/1997 | Dohi et al. | 227/130 |
| 5,713,313 A | * | 2/1998 | Berry | 123/46 SC |
| 6,045,024 A | * | 4/2000 | Phillips | 227/10 |
| 6,102,270 A | * | 8/2000 | Robinson | 227/10 |
| 6,145,724 A | * | 11/2000 | Shkolnikov et al. | 227/130 |

FOREIGN PATENT DOCUMENTS

| | | |
|---|---|---|
| JP | 3-25307 | 4/1991 |

* cited by examiner

*Primary Examiner*—Scott A. Smith
(74) *Attorney, Agent, or Firm*—Sughrue Mion, PLLC

(57) ABSTRACT

A combustion-powered nail gun includes a housing, a combustion chamber wall, and a blocking member. The combustion chamber wall is disposed within the housing. The combustion chamber wall has an inner surface that defines a combustion chamber and an outer surface that is separated from the inner surface of the housing by a space. The combustion chamber wall has an inlet in its upper end and an outlet in its lower end. The combustion chamber wall moves vertically within the housing between an open position wherein the inlet and the outlet are opened and a sealed position wherein the inlet and the outlet are closed. The blocking member is provided for preventing flow of air through the space between the inner surface of the housing and outer surface of the combustion chamber.

6 Claims, 6 Drawing Sheets

COMBUSTION-POWERED NAIL GUN

BACKGROUND OF THE INVENTION

1. Field of the Invention

The present invention relates to a combustion-powered nail gun that generates drive force by igniting a gas/air mixture to drive a nail into a work piece.

2. Description of Related Art

U.S. Pat. No. 5,197,646 discloses a conventional combustion-powered tool assembly. FIG. 1 schematically shows configuration of a conventional combustion-powered nail gun 1 similar to that disclosed in U.S. Pat. No. 5,197,646. The nail gun 1 includes a housing 14, a handle 11, a tail cover 17, a push lever 21, and a magazine 13.

The housing 14 accommodates therein a head cover 23, a combustion chamber wall 15, a cylinder 4, and a piston 10. The combustion chamber wall 15, the head cover 23, and the piston 10 together define a combustion chamber 5. The head cover 23 and the cylinder 4 are fixed with respect to the housing 14. The combustion chamber wall 15 is vertically movable within the housing 14 as guided by the housing 14 and the cylinder 4. Although not shown in the drawings, a connection rod linkingly connects the combustion chamber wall 15 with the push lever 21 so that the combustion chamber wall 15 and the push lever 21 move together in a ganged manner. Further, a spring (not shown) is provided for urging the push lever 21 downward. Therefore, the push lever 21 and the combustion chamber wall 15 are in their lower most position shown in FIG. 1 while no force operates against the urging force of the spring. At this time, because the head cover 23 and the cylinder 4 are fixed, an inlet 26 is opened between the head cover 23 and the combustion chamber wall 15 and an outlet 25 is opened between the cylinder 4 and the combustion chamber wall 15. Although not shown in the drawings, seals for forming a tight seal at the inlet 26 and the outlet 25 are provided at the lower end of the head cover 23 and the upper end of the cylinder 4. An intake vent 30 is provided in the upper end of the housing 14 and a discharge vent 32 is provided in the lower end of the housing 14.

The housing 14 further accommodates a motor 8, a spark plug 9, and a gas canister connection 7 in a space above the head cover 23. The gas canister connection 7 is connected to a gas canister (not shown) that hold combustible gas. An injection port 22 connects the gas canister connection 7 with the inside of the combustion chamber 5 and supplies combustible gas from the gas canister connection 7 into the combustion chamber 5. A fan 6 is disposed in the combustion chamber 5. The fan is attached to and rotated by the drive shaft of the motor 8. Electrodes of the spark plug 9 are exposed in the combustion chamber 5. Ribs 24 are provided on the inner surface of the combustion chamber wall 15 so as to protrude into the combustion chamber 5.

The piston 10 is supported by a slide seal member (not shown) so as to be vertically movable in the cylinder 4. A bumper 2 is provided below the piston 10 for absorbing excessive energy of the piston 10 after a nail driving operation. Also, an exhaust hole 3 is formed in the cylinder 4. A check valve (not shown) of well-known construction is provided on the exhaust hole 3 and the outer side of the exhaust hole 3.

The handle 11 is attached to a middle section of the housing 14. A trigger 12 is provided on the handle 11. Each time the trigger 12 is pulled (turned on), the spark plug 9 generates a spark.

The magazine 13 and the tail cover 17 are attached to the lower end of the housing 14. The magazine 13 is filled with nails (not shown). The magazine 13 feeds the nails one at a time to the tail cover 17. The tail cover 17 sets the nails fed from the magazine 13 in a position below the piston 10 and guides movement of the nails when the nails are driven downward by the piston 10.

FIG. 1 shows the nail gun 1 before a nail driving operation is performed. At this time, the push lever 21 is urged downward by the spring (not shown) to protrude below the lower end of the tail cover 17. The combustion chamber wall 15 is also in its lowermost position so that the inlet 26 is open between the combustion chamber wall 15 and the head cover 23 and the outlet 25 is open between the combustion chamber wall 15 and the cylinder 4. Also, the piston 10 is in its top dead position before a nail driving operation starts.

Next, a nail driving operation by the nail gun 1 will be described with reference to FIGS. 1 to 4. FIGS. 1 to 4 show changes in the nail gun 1 in chronological order when a nail driving operation is performed.

To prepare to drive a nail into a work piece 27, the user grips the handle 11 and presses the push lever 21 against the work piece 27 as shown in FIG. 2. As a result the push lever 21 rises upward against the urging force of the spring and the combustion chamber wall 15, being connected to the push lever 21, moves upward also into the position shown in FIG. 2. When the combustion chamber wall 15 moves upward in this manner, the inlet 26 and the outlet 25, which are above and below the combustion chamber wall 15 respectively, close up to seal close the combustion chamber 5 with the seals (not shown). In a linked operation, the gas canister connection 7 is pressed and so supplies combustible gas from the gas canister (not shown) to the injection port 22, which injects the combustible gas into the combustion chamber 5. Further, the motor 8 is turned on to rotate the fan 6. The injected combustible gas and air in the combustion chamber 5 are agitated and mixed together by rotation of the fan 6 in the sealed off combustion chamber 5 and influence of the ribs 24 that protrude into the combustion chamber 5.

Next, the user pulls the trigger 12 on the handle 11 to generate a spark at the spark plug 9. The spark ignites and explodes the air/gas mix in the combustion chamber 5. The gas expands as a result. The expanding gas drives the piston 10 downward as shown in FIG. 3 to drive the nail that is set in the tail cover 17 into the work piece 27.

Directly after combustion, the combusted gas that remains in the cylinder 4 and the combustion chamber 5 is extremely hot and in a high pressure state from having expanded. Because, as shown in FIG. 3, the piston 10 is in contact with the bumper 2 at a position below the exhaust hole 3, the combusted gas from the combustion chamber 5 flows through the exhaust hole 3 to outside of the cylinder 4 until the pressure in the cylinder 4 and the combustion chamber 5 reaches atmospheric pressure, whereupon the check valve in the exhaust hole 3 closes shut. During this time, the inner surface of the cylinder 4 and the inner surface of the combustion chamber wall 15 absorb the heat of the combusted gas so that the combusted gas rapidly cools and contracts. Therefore, after the check valve (not shown) closes, pressure in the thus sealed combustion chamber 5 above the piston 10 decreases to below atmospheric pressure. This is referred to as a thermal vacuum. This thermal vacuum pulls the piston 10 back to the upper dead position of before the nail driving operation.

After the nail is driven into the work piece 27, the user releases the trigger 12 and lifts the nail gun 1 upward away from the work piece 27. When the push lever 21 separates from the work piece 27, the spring (not shown) urges the push lever 21 and the combustion chamber wall 15 back into the positions shown in FIG. 4. Even after the trigger 12 is released and turned off, a control unit (not shown) continues rotation of the fan 6 for a fixed period of time to scavenge the combusted gas in the combustion chamber 5. That is, in the condition shown in FIG. 4, the inlet 26 and the outlet 25 are opened up above and below the combustion chamber wall 15 respectively. The combusted gas in the combustion chamber 5 is scavenged by rotation of the fan 6, which generates an air flow 16 that draws clean air in through the intake vent 30 and that exhausts combusted gas from the discharge vent 32. After the scavenging operation, the fan 6 is stopped. At this point, the nail gun 1 has returned to the initial condition shown in FIG. 1.

SUMMARY OF THE INVENTION

FIG. 5 shows the nail gun 1 after a nail driving operation. In this condition, the piston 10 is in its initial upper dead position and the fan 6 is generating the air flow 16 to scavenge the combusted air. During scavenging, a circulating flow 28 is generated that flows through a space S between the outer surface of the combustion chamber wall 15 and the inner surface of the housing 14. The circulating flow 28 returns a portion of the combusted gas back into the combustion chamber 5. As a result, a longer time is required to completely scavenge the combusted air. More time is required between successive nail driving operations, so that overall a series of nail drives takes longer. Efficiency of work using the nail gun 1 suffers.

FIG. 6 shows a modification of the conventional nail gun 1 wherein the intake port 30 is position adjacent to the inlet 26 and the discharge vent 32 is position adjacent to the outlet 25. This configuration reduces the resistance to the air flow 16 generated by the fan 6. However, a negative pressure develops in an area A near the inlet 26 due to the fan 6. Also, a positive pressure develops in an area B near the outlet 25 below the combustion chamber wall 15. This pressure difference generates the circulating flow 28. From this modification, it can be understood that the problem of the circulating flow 28 cannot be solved by merely changing the location of the intake and exhaust vents.

It is an objective of the present invention to eliminate or at lest greatly reduce this circulation flow in order to reduce the time required for scavenging and enable nail drive operations to be made rapidly in succession.

To achieve the above-described objective, a combustion-powered tool according to the present invention includes a housing, a push lever, a combustion chamber, a cylinder, a piston, an item setting unit, a gas injection unit, a drive start unit, and a blocking member.

The housing has an upper end, a lower end, an inner surface, and an outer surface.

The push lever is supported at the lower end of the housing.

The combustion chamber wall is disposed within the housing. The combustion chamber wall has an inner surface, an outer surface, an upper end, and a lower end. The inner surface of the combustion chamber wall substantially defines a combustion chamber. The outer surface of the combustion chamber wall is in confrontation with the inner surface of the housing and is separated from the inner surface of the housing by a space. The combustion chamber wall has an inlet in the upper end and an outlet in the lower end. The combustion chamber wall moves vertically within the housing in a ganged manner with the push lever between an open position wherein the inlet and the outlet are opened and a sealed position wherein the inlet and the outlet are closed.

The cylinder is disposed below and is in fluid communication with the combustion chamber. The piston is disposed in the cylinder and partially defines the combustion chamber with the combustion chamber wall. The piston is capable of vertical movement guided by the cylinder. The item setting unit is disposed at the lower end of the housing and sets the item in a position below the piston. The gas injection unit injects combustible gas into the combustion chamber.

The drive start unit ignites and explodes the combustible gas injected into the combustion chamber. The piston is driven downward in the cylinder by resultant expansion of gas in the combustion chamber and drives the item set in the item setting unit downward.

The blocking member blocks air from flowing between the upper end of the housing and the lower end of the combustion chamber wall through the space between the inner surface of the housing and outer surface of the combustion chamber.

DETAILED DESCRIPTION OF THE EMBODIMENTS

Figure 1:
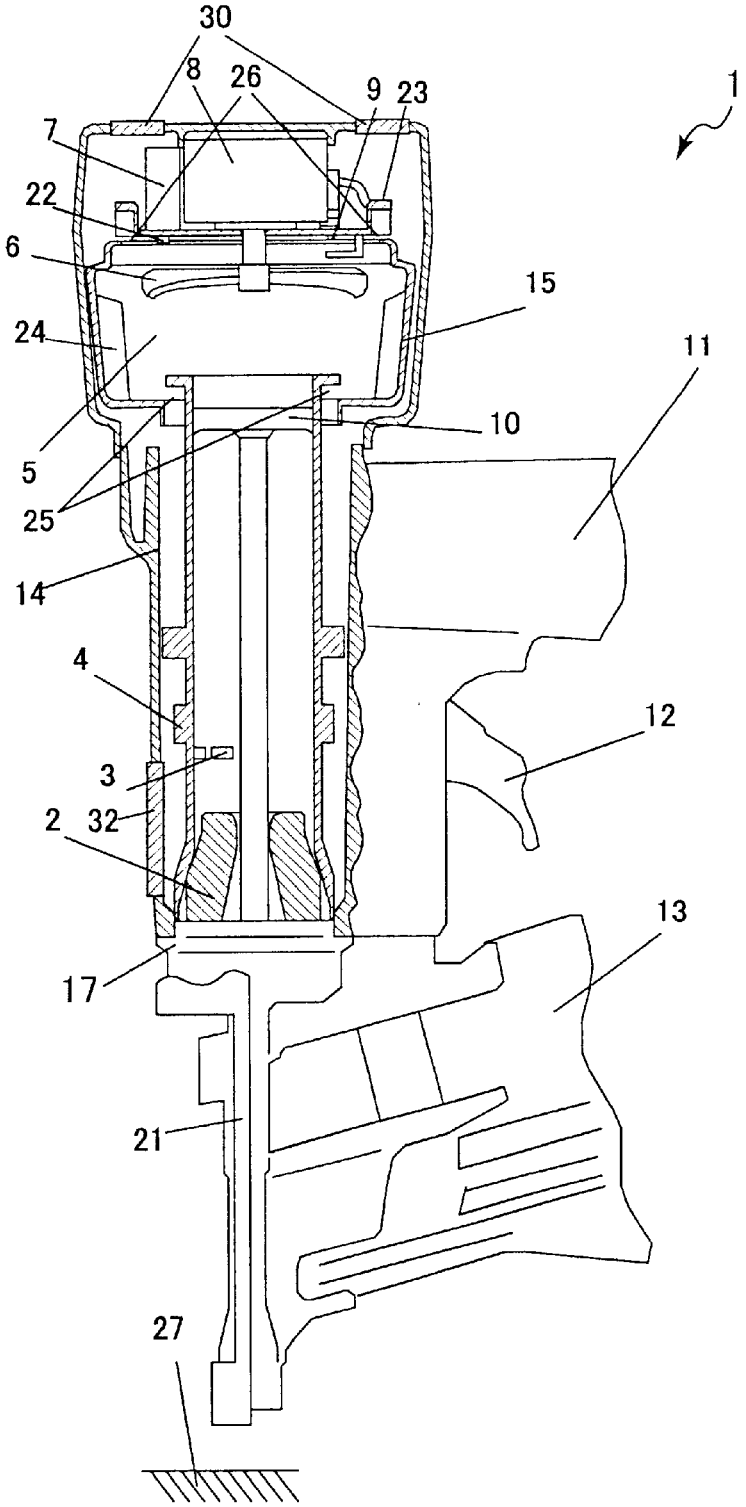
FIG.1 PRIOR ART
FIG. 1 is a side view in partial cross-section showing a conventional combustion-powered nail gun in an initial condition before a nail driving operation is performed.
Figure 2:
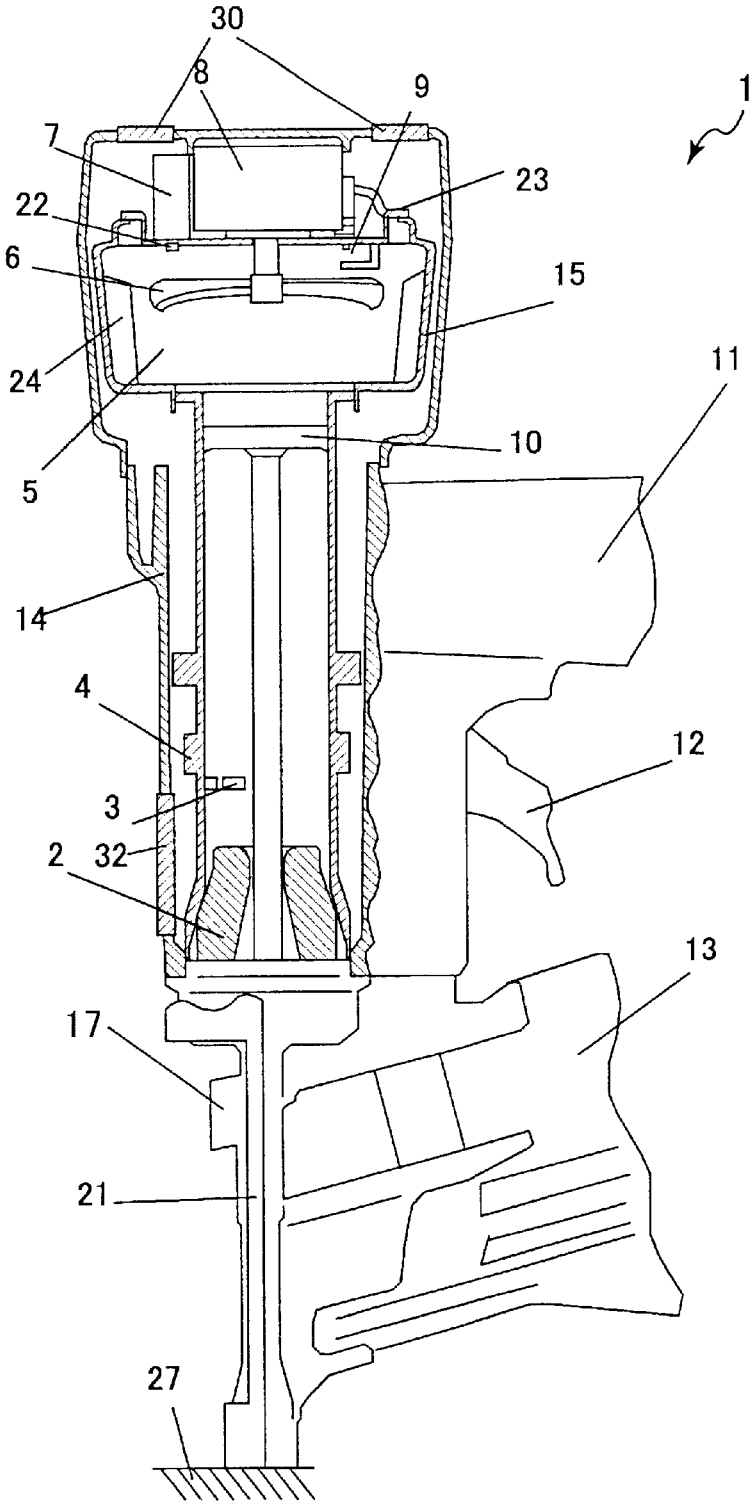
FIG.2 PRIOR ART
FIG. 2 is a side view in partial cross-section showing the conventional combustion-powered nail gun of FIG. 1 prepared to start a nail driving operation.
Figure 3:
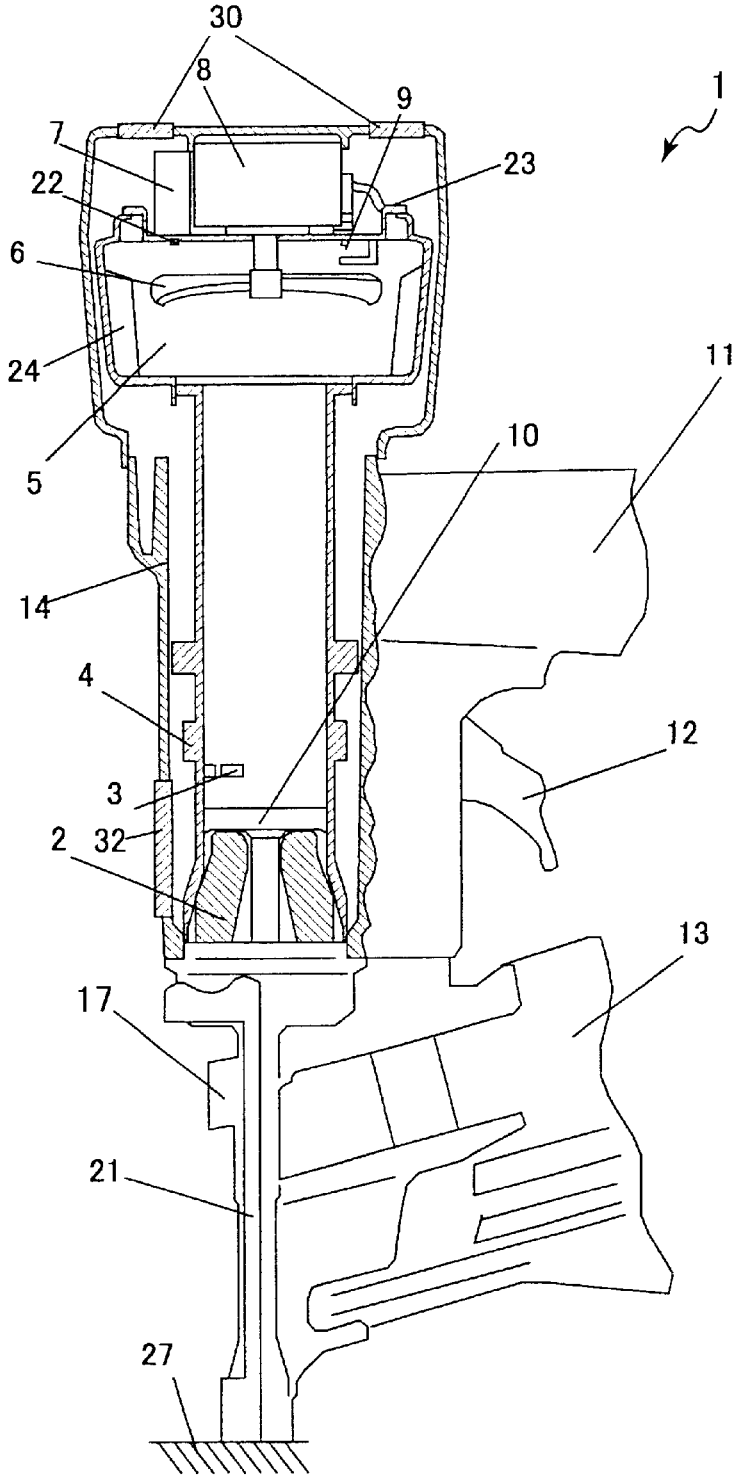
FIG.3 PRIOR ART
FIG. 3 is a side view in partial cross-section showing the conventional combustion-powered nail gun of FIG. 1 after driving a nail into a work piece, wherein the piston is in the lower dead position.
Figure 4:
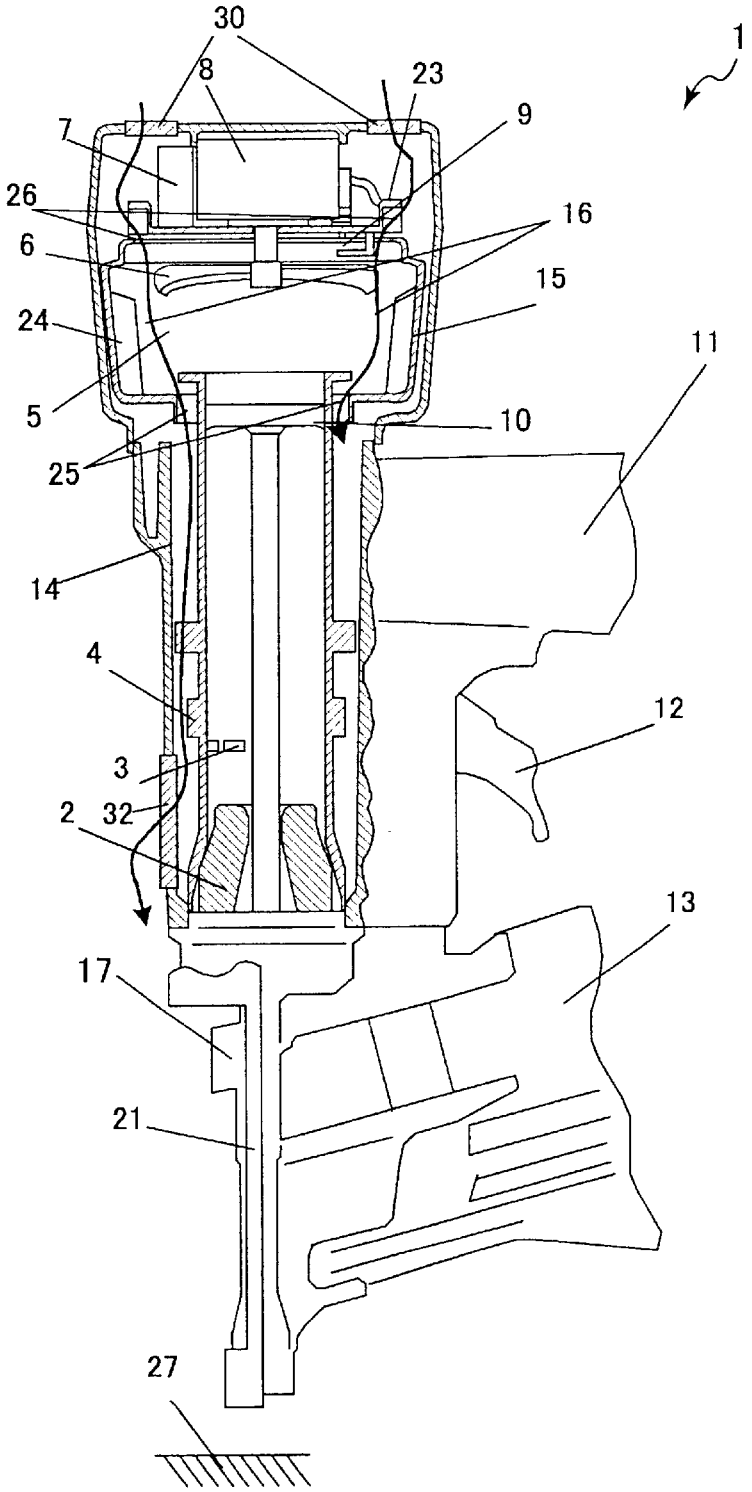
FIG.4 PRIOR ART
FIG. 4 is a side view in partial cross-section showing the conventional combustion-powered nail gun after completion of a nail driving operation, wherein components have returned back to their initial positions shown in FIG. 1.
Figure 5:
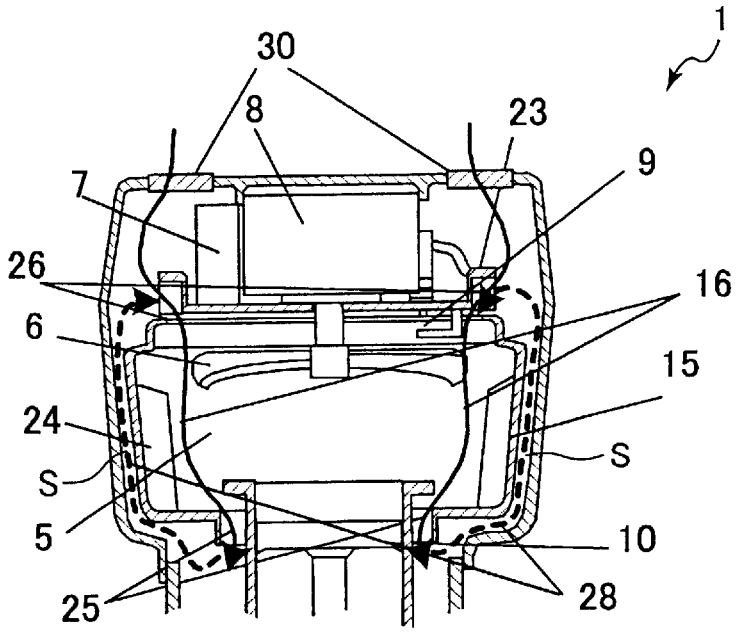
FIG. 5 is a cross-sectional view showing an undesirable circulating flow generated during scavenging in the conventional combustion-powered nail gun of FIG. 1.
Figure 6:
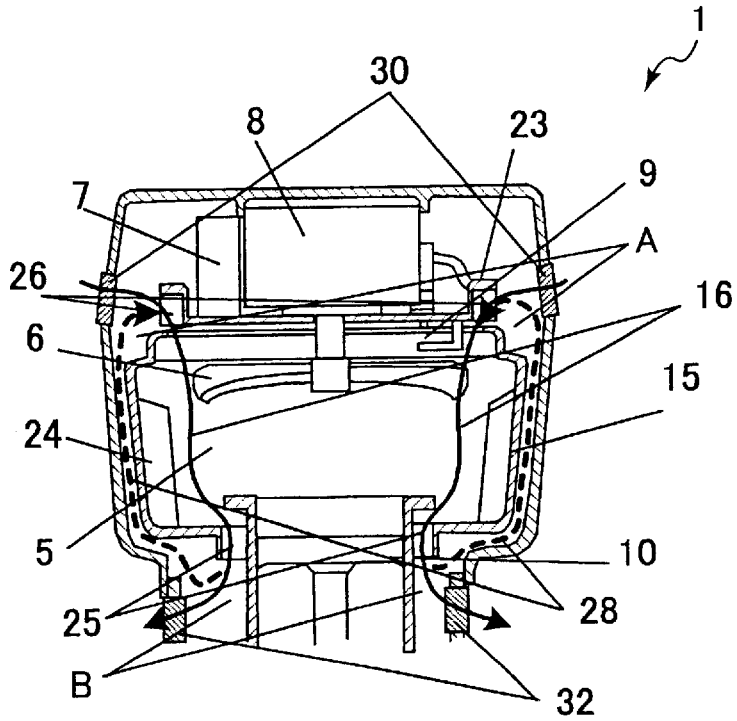
FIG. 6 is a cross-sectional view showing a modification of the conventional combustion-powered nail gun in FIG. 1.

Next, combustion-powered nail guns according to embodiments of the present invention will be described with reference to FIGS. 7 and 8. Components of the combustion-powered nail guns according to the embodiments that are similar to those of the conventional combustion-powered nail gun 1 shown in FIG. 1 are indicated with the same numbering in FIGS. 7 and 8 and their explanation will be omitted to avoid redundancy of explanation. Also, the combustion and scavenging operations of the combustion-powered nail guns of the embodiments are similar to the conventional ones.

First, a combustion-powered nail gun 100 according to a first embodiment of the present invention will be described with reference to FIG. 7. FIG. 7 shows the combustion-powered nail gun 100 with the combustion chamber wall 15 in the lowermost condition after a nail driving operation.

Figure 7:
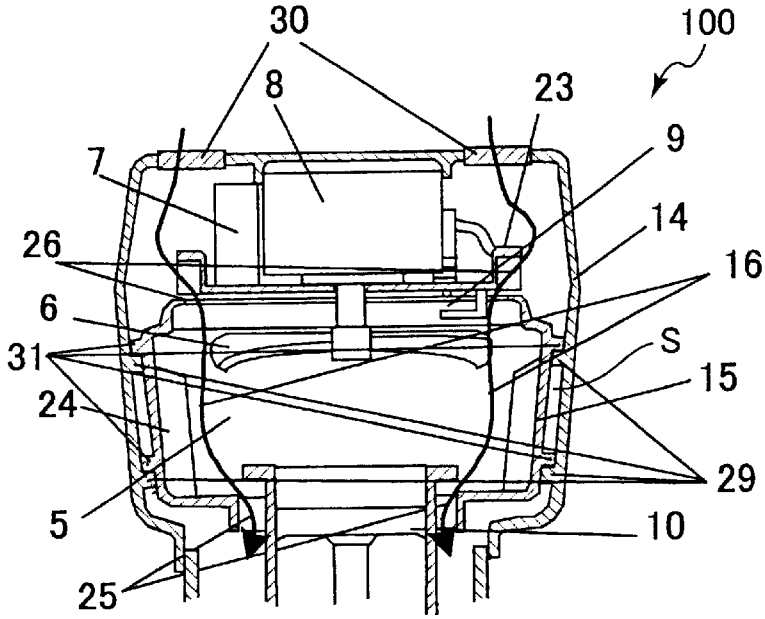
FIG. 7 is a cross-sectional view showing a combustion-powered nail gun according to a first embodiment of the present invention.

As shown in FIG. 7, the housing 14 includes two ribs 29, that is, an upper rib and a lower rib, that follow around its inner peripheral surface in confrontation with the combustion chamber wall 15. Each rib 29 protrudes toward the combustion chamber wall 15 into the space S between the housing 14 and the combustion chamber wall 15. Similarly, the combustion chamber wall 15 includes two ribs 31, that is, and upper rib and a lower rib, that follow around its outer peripheral surface. The ribs 31 protrude toward the housing 14 into the space S between the housing 14 and the combustion chamber wall 15. As shown in FIG. 7, each of the ribs 31 abuts down on the corresponding one of the ribs 29 while the combustion chamber wall 15 is in the lowermost position, which is the position in which scavenging is performed. In this condition, the ribs 29, 31 block fluid communication between from the inlet 26 to the outlet 25 through the space S between the outer surface of the combustion chamber wall 15 and the inner surface of the housing 14. Therefore, the ribs 29, 31 block the flow of air from the inlet 26 to the outlet 25 through the space S during scavenging while the fan 6 generates the air flow 16. As a result, the circulating flow 28 is not generated so that the duration of scavenging can be reduced. The ribs 29, 31 also serve as a stopper for stopping the lowering motion of the combustion chamber wall 15.

Figure 8:
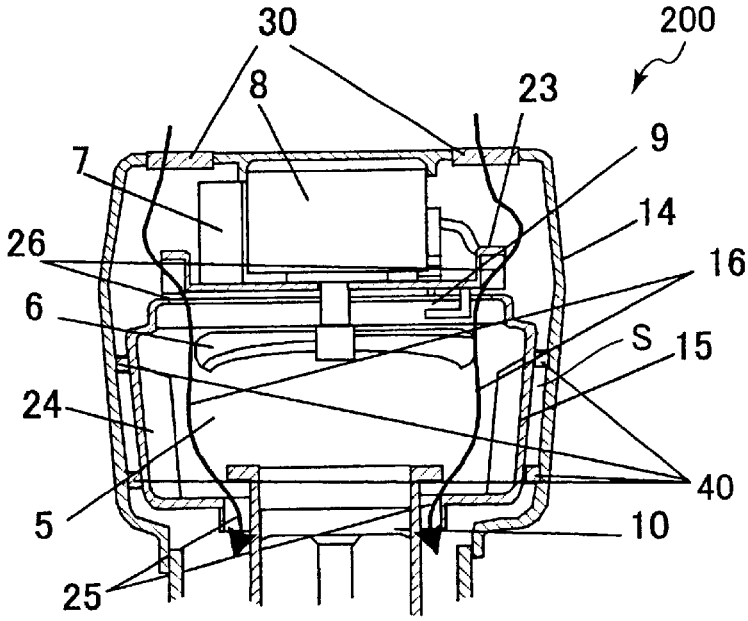
FIG. 8 is a cross-sectional view showing a combustion-powered nail gun according to a second embodiment of the present invention.

FIG. 8 shows a combustion-powered nail gun 200 according to a second embodiment of the present invention. The combustion-powered nail gun 200 according to the second embodiment includes blocking members 40 attached to the inner surface of the housing 14. The blocking members 40 block fluid communication between from the inlet 26 to the outlet 25 through the space S between the outer surface of the combustion chamber wall 15 and the inner surface of the housing 14. Therefore, the blocking members 40 block the flow of air from the inlet 26 to the outlet 25 through the space S during scavenging while the fan 6 generates the air flow 16. As a result, the circulating flow 28 is not generated so that the duration of scavenging can be reduced. According to the present embodiment, the blocking members 40 are formed from a soft material such as rubber. With this configuration, the blocking members 40 also serve to maintain the combustion chamber wall 15 in its lowermost position during scavenging.

While the invention has been described in detail with reference to the specific embodiments thereof, it would be apparent to those skilled in the art that various changes and modifications may be made therein without departing from the spirit of the invention.

For example, the first embodiment describes that the housing 14 includes two ribs 29 and the combustion chamber wall 15 includes two ribs 31. However, the housing 14 need only be provided with one rib 29 and the combustion chamber wall 15 need only be provided with one rib 31.

Also, the second embodiment describes that the blocking members 40 are attached to the inner surface of the housing 14. However, the blocking member 40 can be attached to the outer surface of the combustion chamber wall 15 instead. Further, whether attached to the inner surface of the housing 14 or to the outer surface of the combustion chamber wall 15, only a single blocking member 40 need be provided in the space S between the housing 14 and the combustion chamber wall 15.

What is claimed is:

1. A combustion-powered tool for driving an item into a work piece, the combustion-powered tool comprising:

a housing having an upper end, a lower end, an inner surface, and an outer surface;

a push lever that is supported at the lower end of the housing;

a combustion chamber wall disposed within the housing, the combustion chamber wall having an inner surface, an outer surface, an upper end, and a lower end, the inner surface of the combustion chamber wall substantially defining a combustion chamber, the outer surface of the combustion chamber wall being in confrontation with the inner surface of the housing and separated from the inner surface of the housing by a space, the combustion chamber wall having an inlet in the upper end and an outlet in the lower end, the combustion chamber wall moving vertically within the housing in a ganged manner with the push lever between an open position wherein the inlet and the outlet are opened and a sealed position wherein the inlet and the outlet are closed;

a cylinder disposed below and in fluid communication with the combustion chamber;

a piston that is disposed in the cylinder and that partially defines the combustion chamber with the combustion chamber wall, the piston being capable of vertical movement guided by the cylinder;

an item setting unit that is disposed at the lower end of the housing and that sets the item in a position below the piston;

a gas injection unit that injects combustible gas into the combustion chamber;

a drive start unit that ignites and explodes the combustible gas injected into the combustion chamber, the piston being driven downward in the cylinder by resultant expansion of gas in the combustion chamber and driving the item set in the item setting unit downward; and a blocking member that blocks air from flowing between the upper end of the housing and the lower end of the combustion chamber wall through the space between the inner surface of the housing and outer surface of the combustion chamber.

2. A combustion-powered tool as claimed in claim 1, the blocking member includes:

a combustion chamber rib that protrudes from the outer surface of the combustion chamber wall toward the housing; and a housing rib that protrudes from the inner surface of the housing toward the combustion chamber wall, the combustion chamber rib and the housing rib overlapping vertically.

3. A combustion-powered tool as claimed in claim 2, wherein the combustion chamber rib and the housing rib come into abutment with each other when the combustion chamber wall is in the open position.

4. A combustion-powered tool as claimed in claim 1, wherein the blocking member is attached to at least one of the inner surface of the housing and the outer surface of the combustion chamber wall.

5. A combustion-powered tool as claimed in claim 1, wherein the housing is formed with an intake hole in the upper end thereof and an exhaust hole in a lower end thereof, the cylinder being formed with an exhaust hole that is in fluid communication with the exhaust hole of the housing and that is brought into fluid communication with the combustion chamber after the piston is driven downward.

6. A combustion-powered tool as claimed in claim 1, further comprising a fan disposed in the combustion chamber, the fan being driven to rotate by a motor that is external to the combustion chamber.

* * * * *